United States Patent [19]

Mills

[11] 4,271,646

[45] Jun. 9, 1981

[54] POST SUPPORT MEANS

[76] Inventor: Derek J. Mills, 2 Avenue Rd., Maidenhead, Berkshire, England

[21] Appl. No.: 739,296

[22] Filed: Nov. 5, 1976

Related U.S. Application Data

[63] Continuation of Ser. No. 566,825, Apr. 10, 1975, abandoned.

[51] Int. Cl.[3] ..... E02D 5/74

[52] U.S. Cl. ..... 52/165; 52/166

[58] Field of Search ..... 52/165, 166

[56] References Cited

U.S. PATENT DOCUMENTS

| | | | |
|---|---|---|---|
| D. 29,550 | 10/1898 | Patterson | 52/165 |
| 165,557 | 7/1875 | Geer | 52/165 |
| 199,949 | 2/1978 | Youngs | 52/165 |
| 207,518 | 8/1878 | Hayden | 52/165 |
| 284,219 | 9/1883 | Mehew | 52/165 |
| 443,622 | 12/1890 | Amos | 52/165 |
| 2,874,547 | 2/1959 | Fiore et al. | 52/165 |

*Primary Examiner*—Price C. Faw, Jr.
*Assistant Examiner*—Carl D. Friedman
*Attorney, Agent, or Firm*—Brisebois & Kruger

[57] ABSTRACT

Post support for supporting vertical fence posts, the bases of sheds or greenhouses, and the like, to the ground comprising an elongate ground-engaging portion, preferably of cross-shaped cross-section and preferably tapered toward its free end, capable of being driven vertically into the ground and a post-engaging portion, preferably a hollow box-section, rigidly attached to the ground-engaging portion and being so formed that a post to be supported and engaged by the post-engaging portion extends with its axis substantially parallel to the axis of the ground-engaging portion.

8 Claims, 4 Drawing Figures

POST SUPPORT MEANS

This is a continuation of application Ser. No. 566,825, filed Apr. 10, 1975 abandoned.

This invention relates to means for supporting vertical posts, for example, posts for supporting fencing or the like, and which can also be used as means for anchoring structures, such as the bases of sheds and greenhouses, to the ground. Both such means will hereinafter be referred to as post support means, for the sake of convenience.

It has hitherto been the practice to erect and support posts by digging a hole of suitable depth and either burying one end of the post in the hole with earth or supporting the post by filling the hole round the post with concrete.

This invention provides a post support means by which posts can be supported without the need for digging a hole and with which posts can be more easily erect at a desired spot without location problems.

The post support of the invention comprises an elongate ground-engaging portion capable of being driven vertically into the ground and a post-engaging portion attached to the ground-engaging portion and being so formed that a post to be supported and engaged by, for example, attached to or received in, the post engaging portion extends vertically and with its axis substantially parallel to the axis of the ground-engaging portion.

Preferably, there is provided a flat plate arranged substantially perpendicular to the axis of the ground-engaging portion interposed between the ground-engaging portion and the post-engaging portion as this helps to limit the extent to which the ground-engaging portion can be driven into the ground when erecting posts.

The ground-engaging portion may be of any desired section, for example of circular, tubular, square, rectangular or tee section but is preferably of cross-shaped cross-section as this provides maximum resistance to lateral movement for a relatively simple shape. When the post is a square post the arms of the cross are preferably arranged to extend diagonally of the post. The cross sectional dimensions of the ground-engaging portion maybe the same all the way along but preferably the ground-engaging portion tapers from the end having the post-engaging means to the free end as this, of course, makes the post support easier to drive into the ground.

The post-engaging portion may comprise simply a vertical plate or plates against which one side of the post may be abutted and which is drilled to receive bolts or screws for fastening the post to the plate or plates. Preferably, however, the post-engaging portion is a hollow box-section of internal dimensions such that the end of a post to be erected can be received within the box section. The walls of the box section may be drilled to receive bolts or screws to anchor the post or the post may be free standing in the box section.

In some cases, for example where the post-support means is required to support a post which has previously been embedded in a concrete block, the person erecting the post may not want to remove the concrete block. In such a case there may be used a post-support means according to the invention which has two spaced-apart ground-engaging portions connected together by a post-engaging portion such that the two ground-engaging portions may be driven into the ground so as to span the concrete block and the post may be bolted or otherwise affixed to the post-engaging portion in substantially the same location as the post originally embedded in the concrete block.

The post support means of the invention may be made from any desired material, which is of sufficient strength but it is preferably made in mild steel plate generally of the order of one-eight inch thickness. In the arrangement described above however in which the post-supporting portion bridges two ground-engaging portions it may be necessary to use plate as thick as one-quarter inch for the post-supporting portion.

The dimensions of the post support means of the invention will of course vary depending on the length of the post to be supported and the amount of movement of the post which is to be expected. It has been found, for example, that for supporting a four-inch square post for supporting fencing six feet long and at a separation of 6 feet, the ground-engaging portion should desirably have a length of approximately 2 feet and the sides of a box-section post-engaging portion should desirably have a height of about 6 inches.

The invention will now be described in greater detail by way of example with reference to the drawings in which.

Figure 1:
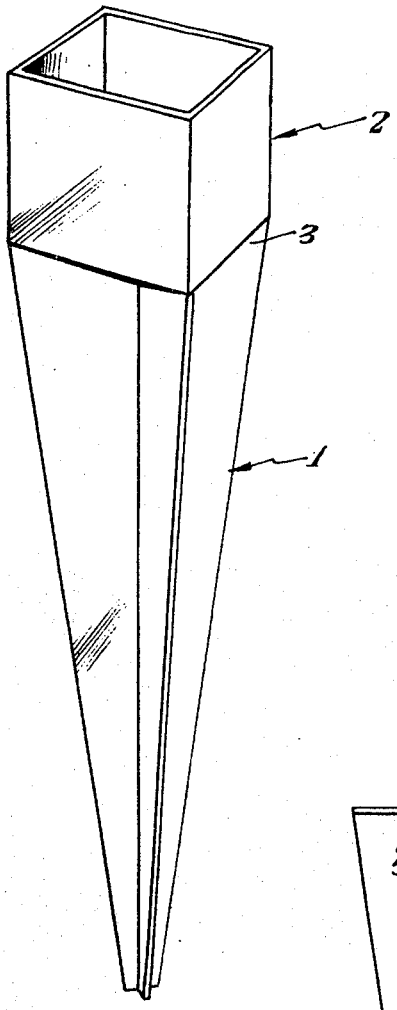
FIG. 1 is a perspective view of one form of post support means.
Figure 2:
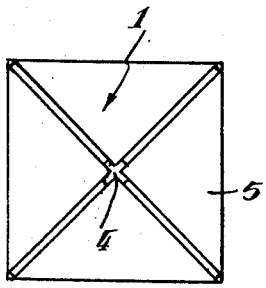
FIG. 2 is an underneath view of the post support means of FIG. 1.

Referring to FIGS. 1 and 2, the first form of post support means comprises a ground-engaging portion 1 and a post-engaging portion 2.

The ground engaging-portion 1 is of cross-shaped cross-section and tapers from the top end 3 at which the post-engaging portion is located to the free end 4.

The post-engaging portions 2 is a box-section and is of such size that its diagonal dimension is substantially the same as the length of the arms of the cross at the top 3 of the ground-engaging portion 1. The box-section is closed at one end by a flat plate 5 which is welded onto the sides of the box-section and also onto the ground-engaging portion 1 at the top end 3 thereof.

To allow drainage of any water entering the box-section drain holes (not shown) may be drilled in the plate 5 or the post box-section may be formed by tack welding at intervals thereby leaving gaps between the plates forming the box-section through which water can drain.

The post to be supported is received in the box-section and fixed by bolts passing through aligned holes (not shown) on opposed sides of the box-section.

Figure 3:
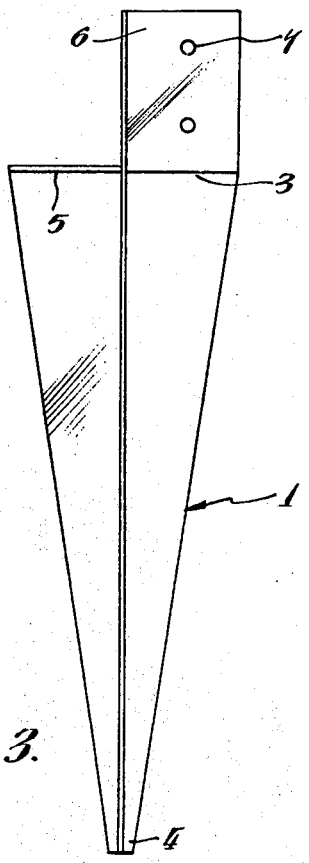
FIG. 3 is a side elevation of a second form of post support means.

Referring to FIG. 3, in the second form of post support means, the ground-engaging portion 1 is the same as shown in FIG. 1 but the post support means 2 merely comprises a vertical plate 6 welded to one side of the flat plate 5 which as in FIG. 1 is welded to the tops of the ground-engaging portion 1.

The plate 6 is drilled at 7 so that the post to be supported may be affixed thereto by bolts or screws. The post to be supported may be fixed on either side of the plate 6 so that it either stands over the ground-engaging portion 1 or to one side of it.

This form of support means may also be used for anchoring the base of a structure, such as a shed or greenhouse, since the plate 6 can be bolted to a side of a rectangular base for such a structure either before or after the ground-engaging portion 1 is driven into the ground. A similar form of support means which has two vertical plates arranged at right angles to one another may be used to support posts or as anchoring means at the corners of a structure having a rectangular base.

This method of anchoring the base of outbuildings has the definite advantage that there is no need for elaborate ground levelling before the base is laid. The ground may be roughly levelled and the base itself levelled by driving the necessary ground-engaging portion further into the ground.

Figure 4:
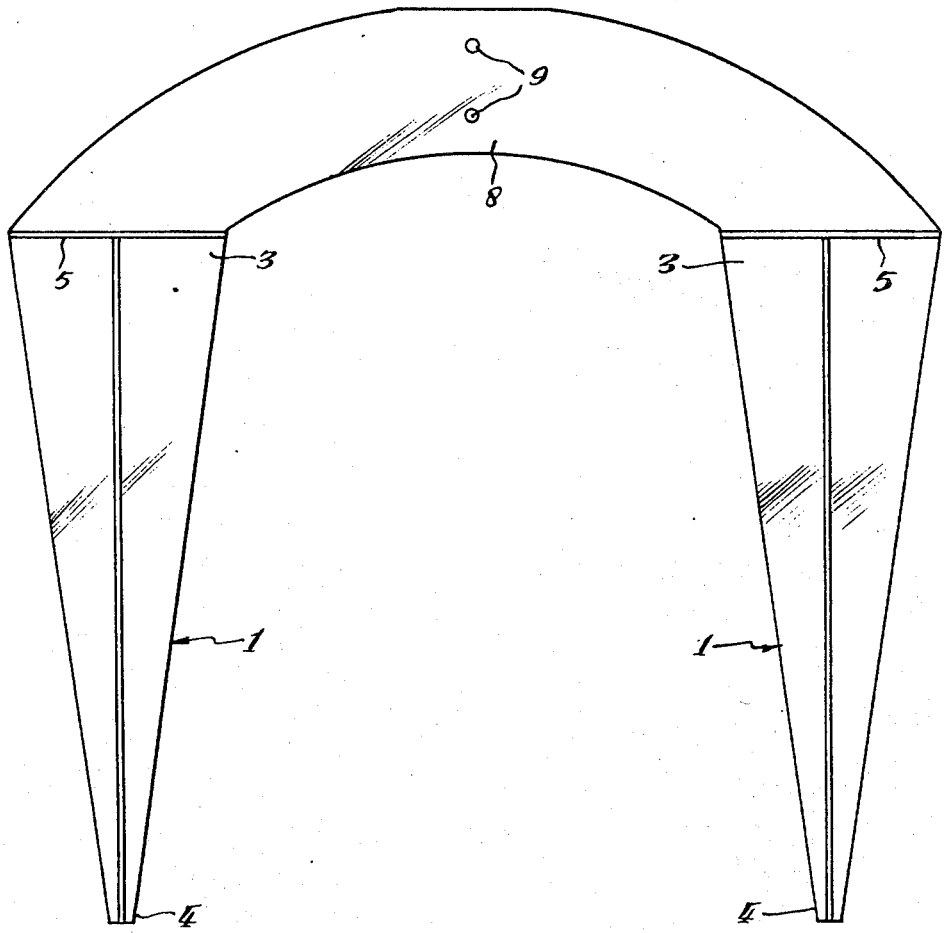
FIG. 4 is a side elevation of a third form of post support means

Referring to FIG. 4, the third form of post support means is intended to straddle a concrete block or the like to enable a post to be erected in the same position as a post which had been embedded in concrete.

This form of post support comprises two ground-engaging portions 1 each of similar form to that described with reference to FIG. 1 and each topped with a flat plate 5. The two ground-engaging portions are connected together by a post-engaging portion 8 in the form of a flat plate having holes 9 so that the post may be affixed to the plate 8 by bolts or screws. Alternatively, a post-receiving box-section may be fixed to the plate 8.

I claim:

1. Post support means comprising an elongate ground engaging portion of cruciform cross-section which is adapted to be driven vertically into the ground, the arms of the cruciform ground engaging portion being arranged diagonally of a rectangular plate portion attached transversely to the ground-engaging portion at one end thereof with no part of the cruciform section extending above the plate portion and no part of the cruciform section extending beyond the periphery of the plate portion, the plate portion being such that when the ground engaging portion is driven into the ground to its full length the plate portion on contacting the surface of the ground will tend to compact the soil and provide increased resistance to further penetration of the ground engaging portion, and a vertical post-engaging portion comprising at least one flat plate member rigidly mounted on the plate portion with its plane parallel to one edge of the plate portion and extending in a direction away from the ground-engaging portion and so oriented that the axis of a post supported and engaged by the post-engaging portion is in substantial alignment with the axis of the ground engaging portion.

2. A post support means as claimed in claim 1, wherein the post-engaging portion comprises a plurality of vertical plates to which the post can be firmly attached.

3. A post support means as claimed in claim 1, wherein the post-engaging portion comprises a box-section in which the post can be received.

4. A post support as claimed in claim 1, wherein the post to be erected is a square post and the arms of the cross are arranged to extend diagonally of the post.

5. A post support means as claimed in claim 1, wherein the ground-engaging portion is tapered towards its free end.

6. A post support according to claim 5 wherein each side of said cruciform portion tapers uniformly from said plate portion to said free end.

7. A method of erecting a post which comprises driving the ground-engaging portion of a post-support means as claimed in claim 1 into the ground and attaching a post to the post-engaging portion.

8. A method of erecting a fence which comprises erecting a plurality of posts by a method as claimed in claim 7 at spaced-apart intervals and attaching fencing members between adjacent posts.

* * * * *